United States Patent [19]

Trevillion

[11] Patent Number: 4,766,764

[45] Date of Patent: Aug. 30, 1988

[54] MAGNETIC FREEPOINT SENSOR UTILIZING SPACED HALL EFFECT DEVICES

[75] Inventor: William L. Trevillion, Houston, Tex.

[73] Assignee: Halliburton Company, Duncan, Okla.

[21] Appl. No.: 18,673

[22] Filed: Feb. 25, 1987

[51] Int. Cl.[4] ..... E21B 47/09

[52] U.S. Cl. ..... 73/151; 166/66

[58] Field of Search ..... 73/151; 365/170; 166/66

[56] References Cited

U.S. PATENT DOCUMENTS 3,443,036 5/1969 Maass ..... 365/170 X 4,440,019 4/1984 Marshall ..... 73/151

*Primary Examiner*—Jerry W. Myracle

*Attorney, Agent, or Firm*—William J. Beard

[57] ABSTRACT

A freepoint indicator apparatus and technique are disclosed wherein a fluid tight hollow non-magnetic body member sized and adapted for passage through a well borehole is used. The apparatus houses a marking coil means for applying magnetic marks to the inside of stuck pipe or tubing string and dual longitudinally spaced Hall effect magnetic field sensing detectors. Magnetic marks are placed inside the stuck pipe. The pipe is then tensioned or torqued, or both, to strain it and the Hall effect devices are used to measure absolute and differential magnetic field strength before and after applying the strain to the pipe. Differences in these quantities are indicated at the location of the free point.

8 Claims, 2 Drawing Sheets

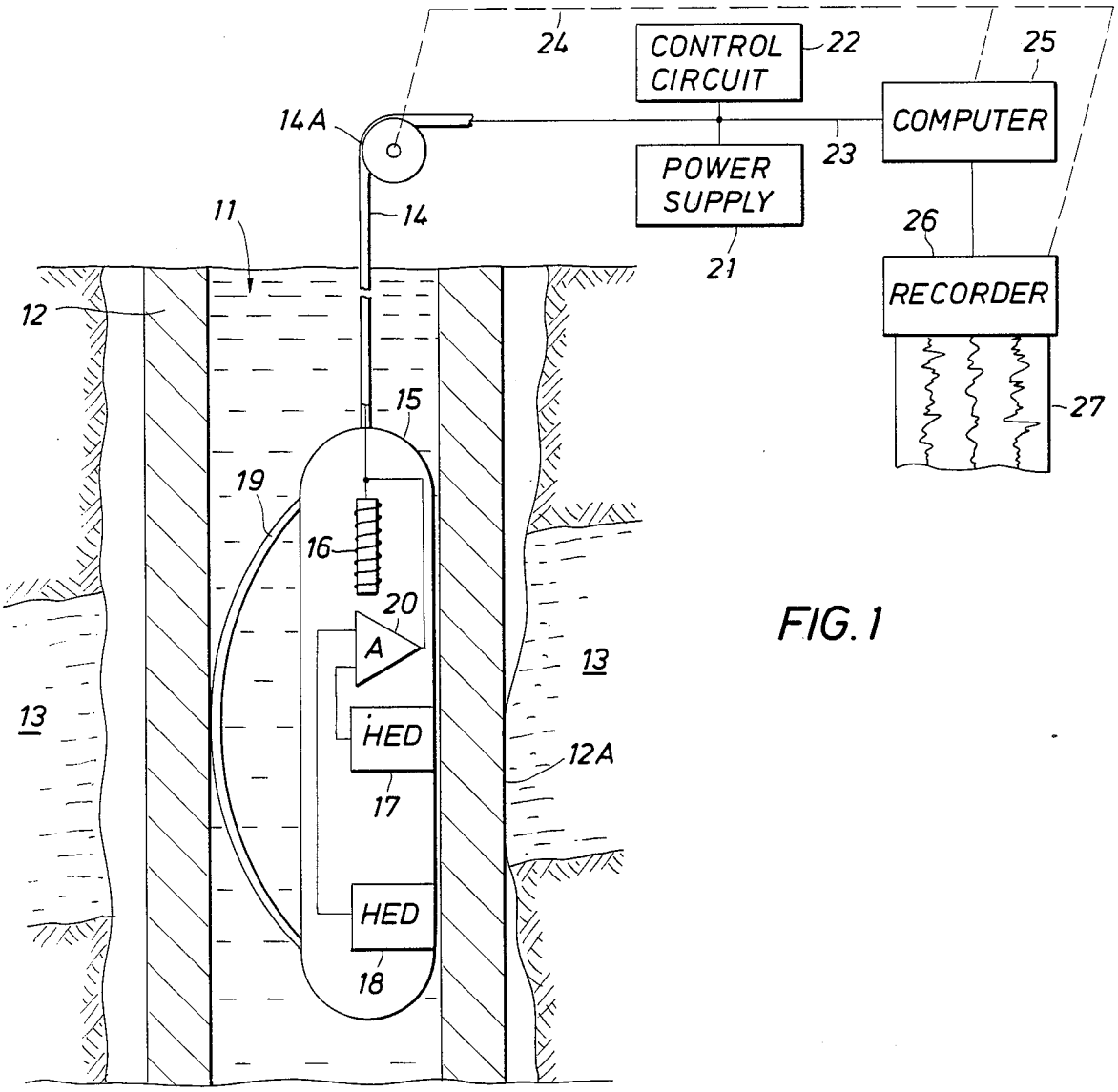
FIG. 1
FIG. 2
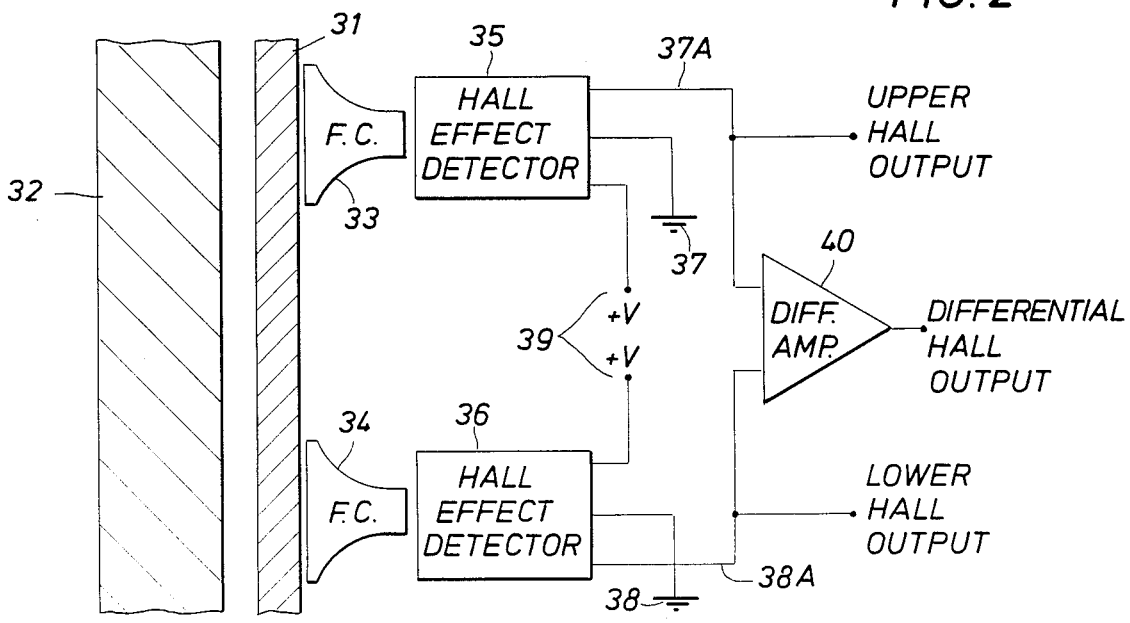

MAGNETIC FREEPOINT SENSOR UTILIZING SPACED HALL EFFECT DEVICES

BACKGROUND OF THE INVENTION

Frequently in drilling an oil or gas well the well borehole penetrates earth formations which may collapse around the drill string and plug the annular space between the drill string and the wall of the borehole. This can cause the drill string to become stuck due to differential pressure between the pressure in the borehole and that in the formation outside the borehole. Similarly drill string or tubing may become stuck due to pressure differentials between the borehole and the formation surrounding the borehole, if over a long interval, the pipe comes in contact with one wall of the borehole such as can be caused by the axis of the borehole drifting from its original vertical line. In either of these events pressure differential between the borehole and the earth formations can cause the drill string or a tubing string suspended in the borehole to become stuck against the earth formation having a lower pressure than the pressure of the drilling fluid in the well borehole. This is always a potential problem in open hole operations.

When this problem occurs remedial operations are required. A typical remedial operation is to unthread or cut by a shaped charge or chemical cutter the pipe or tubing string at a point just above the location where the differential pressure causes the sticking. In other words, the upper portion of the stuck string of pipe or tubing are severed from the lower portion and removed from the borehole. Subsequent alternate operations such as drilling can then be undertaken to remove the lower portion of the stuck pipe string. In these situations it becomes very important to determine the depth level at which the pipe or drill string is stuck in the borehole. Techniques for doing this are known as freepoint indicating techniques.

The art is replete with methods and apparatus for determining freepoint of stuck pipe. One recently developed technique which is assigned to the assignee of the present invention is that shown in U.S. Pat. No. 4,440,019 to Marshall. In the technique of the Marshall Patent a freepoint indicating tool having a magnetic field coil is lowered into a stuck string of pipe or tubing. As the freepoint indicator is moved along the stuck pipe string or tubing string the magnetic coil in the pipe is pulsed with direct current causing an intense magnetic field to be generated in the vicinity of the non-magnetic body of the freepoint indicator. This magnetic field magnetizes or causes magnetic marks on the walls of the tubing string or pipe string as the freepoint indicator is moved through the string of pipe or tubing. Residual magnetism from these marks is then detected by lowering the tool again to a location past where the marks were begun and by moving the coil up the tubing string and this time using it as a sensing coil to sense the magnetic fields caused by the residual magnetism left from the magnetic marks. If a torque or tension is applied to the string of stuck pipe or tubing the portion of the string of stuck pipe or tubing above the stuck point or freepoint can strain or deform due to the torque or tension applied thereto. This strain causes a changing of the residual magnetic field in the pipe at those locations where the magnetic marks have been made. A second pass using the coil as a detector coil is then made past the magnetic marks and the amplitude of each mark is examined and compared with the amplitude of the mark as recorded prior to the tensioning or torquing of the pipe or tubing string. Thus by comparing the magnetic marks before and after the torquing or tensioning operation, changes in amplitude can be used to indicate the point at which the pipe is stuck in the well borehole.

One problem which is encountered in this type of freepoint indicating system is that when using the coil as a detector rather than a marker, the voltage which is induced in the coil by moving it past the residual magnetic marks on the pipe is proportional to the number of turns in the coil (which of course remains constant) but is also proportional to the speed of movement of the instrument past the magnetic mark. As it is normally desired to move the instrument at a constant speed past the magnetic marks this normally does not present a problem. However if the pipe has scale, rust or other irregularities on the inside surface thereof the tool may move in a jerky fashion and may be accelerated starting and stopping due to tensioning in the cable and grappling of the tool with the inside surfaces of the pipe or tubing string causing resistance to its movement in a uniform manner. Thus the assumption that the tool is moving at a constant speed past the magnetic marks when using the coil as a detector may not always be valid. This can lead to false indications of change in the residual magnetic field intensity caused by tool movement rather than by actual changes in the magnetic field due to tensioning or torquing the pipe. This problem can be overcome by using a freepoint indicating system in accordance with the concepts of the present invention.

In the present invention the magnetic field sensing means which are used are sensitive to the magnetic field independent of the speed of movement of the instrument past the magnetic marks placed on the interior of the stuck pipe or tubing string.

BRIEF DESCRIPTION OF THE INVENTION

The method and apparatus of the present invention comprises an improvement over that of the device shown in U.S. Pat. No. 4,440,019 which specification is incorporated herein by reference. Briefly, the freepoint indicator of the present invention is placed in a stuck pipe or tubing string and lowered to a depth below the point at which it is believed the pipe is stuck. Upward movement of the instrument is then begun. A switch is operated as a function of time or movement of the tool along the stuck pipe string to supply a DC current from a current source such as a power supply and a storage capacitor to an electromagnet coil or magnetic marking means carried in the tool body. The DC current pulse applied to the marking coil causes an intense magnetic field which passes through the non-magnetic tool housing and which places a magnetic mark on the interior of the surrounding stuck pipe or tubing string. Even after the tool has passed the magnetic mark remains on the interior of the pipe in the form of residual magnetism. Many such marks are made on the stuck pipe string along the length extending from below the stuck point to above the stuck point. It is intended that the magnetic marks be placed along the pipe string spanning the location of the point of sticking or the freepoint. The freepoint or stuck point is traversed above and below by such magnetic marks which may then be used for subsequent location of the freepoint. The instrument is then lowered to approximately the same initial position and moved upwardly in the stuck tubing string but now no magnetic marks are applied. Spaced magnetic field sensors comprising Hall effect devices longitudinally spaced along the body of the non-magnetic freepoint indicating tool are moved past the magnetic marks caused by the residual magnetism in the pipe. Outputs of these Hall effect devices which are not sensitive to the speed of movement of the tool but are directly proportional to the magnetic field intensity in their vicinity are sent to the surface on conductors of the well logging cable and plotted as a function of depth. In addition to the absolute magnetic field intensity at each Hall effect device, the differential magnetic field between the two longitudinally spaced Hall effect devices is similarly plotted as a function of depth of the instrument in the stuck pipe or tubing string.

Once the initial recording of the differential magnetic field intensity and the absolute magnetic field intensity has been made, the instrument is lowered again to approximately the initial marking depth and a strain is placed on the stuck pipe or tubing string as for instance applying a lifting force or a torque or both to the pipe. When this occurs the stress put in the pipe causes a strain or displacement of the pipe from the well head to the freepoint. Below the freepoint the strain is not transmitted in the stuck pipe or tubing because of the fact that the freepoint acts as a termination of the mechanical length of pipe which is free to move. While maintaining this strain on the pipe, the freepoint indicator is moved upwardly in the tubing string and again the spaced Hall effect devices record the absolute magnetic field intensity and differential magnetic field intensity between their locations as a function of depth. As this detection is not sensitive to the speed of movement of the instrument in the pipe or tubing string the recording which is made may be compared with that made prior to applying the strain on the pipe and the diminution of the absolute magnetic field strength of marks above the freepoint and the existence of a differential magnetic field intensity which can only exist above the freepoint may be observed from the recording.

Moreover, the device of the present invention comprises an improvement over the previously mentioned freepoint device from the standpoint that the coil which is used to mark the tubing magnetically may now be designed as an optimum marking coil rather than be a compromised coil which is used for both marking and sensing magnetic marks in the pipe as disclosed in the aforementioned U.S. Patent of Marshall.

The prior descriptions of the invention are intended as illustrative only and not as limiting. The invention is best understood by reference to the following detailed description thereof when taken in conjunction with the accompanying drawings in which.

BRIEF DESCRIPTION OF THE DRAWINGS

FIG. 1 is a schematic diagram illustrating a freepoint indicating system according to the concepts of the present invention deployed in a stuck pipe string in a well borehole;

FIG. 2 is a detail of a portion but still schematically of the apparatus of FIG. 1 showing the deployment of the Hall effect devices and circuitry associated therewith;

DESCRIPTION OF THE PREFERRED EMBODIMENT

Figure 3:
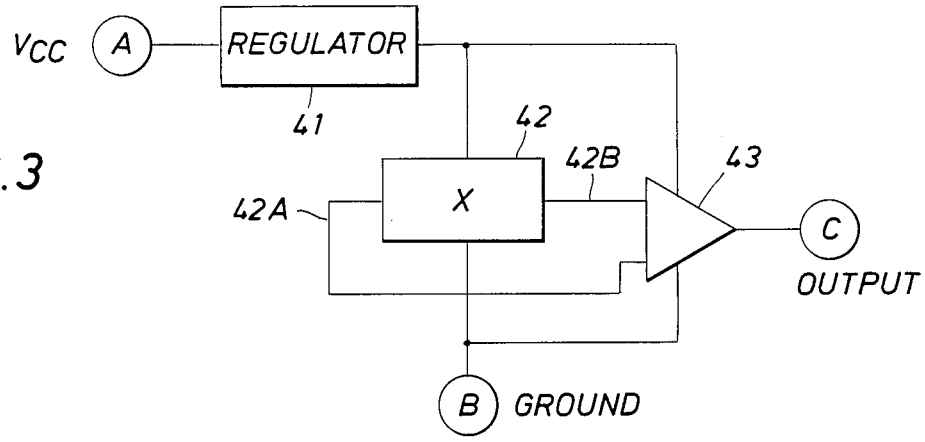
FIG. 3 is a schematic diagram illustrating the circuitry of an individual Hall effect device.

Referring initially to FIG. 1 a fluid filled well borehole 11 is illustrated schematically and having a tubing string or casing 12 which is stuck at location 12a by touching the wall of the borehole as it penetrates earth formations 13. A well logging instrument or freepoint indictor indicated generally at 15 is suspended by an armored well logging cable 14 shown passing over a surface sheave wheel **14*a*. The freepoint indicator logging instrument 15 is urged against one side of the casing by a bow spring 19 in a manner known in the art. The downhole instrument 15 contains a marking coil 16 and two longitudinally spaced Hall effect detectors 17 and 18. The Hall effect detectors are connected to an amplifier 20 which amplifies output signals therefrom for transmission to the surface via conductors of the well logging cable 14**.

At the surface, control circuits 22 are shown for energizing the marking coil 16 along with a power supply 21. Signals from the downhole instrument are conducted to a surface computer 25 which is used to drive a recorder 26 to produce a record medium 27 which contains outputs from the downhole freepoint indicator as a function of depth in the well borehole of the instrument 15. The computer 25 and recorder 26 receive depth information from the sheave wheel **14*a* as indicated by dotted line 24. Thus the computer 25 and recorder 26 are enabled to produce a record medium 27** having an output as a function of borehole depth.

Referring now to FIG. 2 the detector portion of the downhole instrument 15 of FIG. 1 is illustrated in somewhat more detail but still schematically. A nonmagnetic material such as fiberglass, stainless steel, or the like forms the wall of the downhole instrument labeled 31 in FIG. 2. The wall of the instrument is shown in intimate engagement with 32 the wall of the ferromagnetic tubing material or casing which is stuck in the well borehole. Two longitudinally spaced Hall effect devices 35 and 36 are illustrated in FIG. 2. Each of the devices is equipped with a flux concentrator 33 and 34. The flux concentrators 33 and 34 comprise highly ferromagnetic alloys (such as iron, cobalt, nickel alloys) which gather magnetic flux lines over a large external area and focus or concentrate them to a smaller internal area due to their shape as illustrated in FIG. 2.

Moreover the Hall effect devices are supplied with plus V operating voltage from a power supply 39. This could comprise a power supply voltage supplied on a conductor of the cable from the surface power supply 21 of FIG. 1 if desired. The Hall effect devices each have three terminals, one of which is an input voltage terminal and one of which is a ground terminal 37 or 38 of FIG. 2. The output of the device is supplied via output lines **37*a* and 38*a*** *l from a third terminal of the device and is supplied to an output terminal for total magnetic field (labeled upper and lower Hall outputs) and to a differential amplifier 40 which supplies a differential output from the pair of longitudinally spaced devices.*

The Hall effect was discovered by E. H. Hall at Johns Hopkins University in 1879. Hall noted that a magnetic field applied to a conductor carrying current produces a voltage across the conductor which is thought to be caused by the deflection of electrons within the conductor solid concentrating the negative charges to one side or the other of the conductor depending upon the influence of the magnetic lines of force. The potential difference across the conductor (or semiconductor) is called the Hall voltage. The Hall coefficent is a characteristic of a particular material and is the ratio of the Hall voltage multiplied by the thickness of the material and divided by the current through the material and the product of the current through the material and the magnetic field strength. For a given material this ratio is constant.

The Hall voltage is proportional to the vector cross product $I \times H$. Where I is current and H is magnetic fixed vectors. If current flow is constant the Hall voltage will be proportional to the magnetic field applied. Thus the device may be used as a magnetic field detector. The production of Hall effect integrated circuits has eliminated problems associated with the discrete component circuit design. Linear Hall effect devices are now produced by several suppliers. A device which is a single ended output and is useful in the application of the present invention is the type UGN-3501T produced by the Sprague Electric Company.

Referring now to FIG. 3 a block diagram of a Hall effect device of the type previously mentioned is illustrated schematically. It will be noted that the device has three terminals A, B and C. A portion of a doped semiconductor labeled 42 in FIG. 3 is shown with a magnetic field applied perpendicularly thereto as indicated by X into the paper. The input terminal A is labeled $V_{cc}$ and is the input terminal for the operating voltage at constant current. A voltage regulator 41 keeps this voltage constant along with the current which is supplied from an external power supply. One terminal of the Hall device 42 is connected to this regulated supply voltage as is one terminal of a differential amplifier 43 which is part of the integrated circuit device itself. The opposite terminal of the differential amplifier 43 is connected to ground potential which is indicated as terminal B of the overall device. Output voltage from the differential amplifier portion of the device is provided at terminal C the output terminal. It will be noted that a Hall voltage taken across the conductor 42 is supplied by lines 42*a* and 42*b* to the differential inputs of differential amplifier 43. Thus when the device is presented with a magnetic field in the direction indicated by the X in FIG. 3, a voltage is produced across the device which is the Hall voltage, which voltage is amplified in the differential amplifier 43 comprising a part of the device and a single ended output is supplied at output terminal C of the device.

Figure 4:
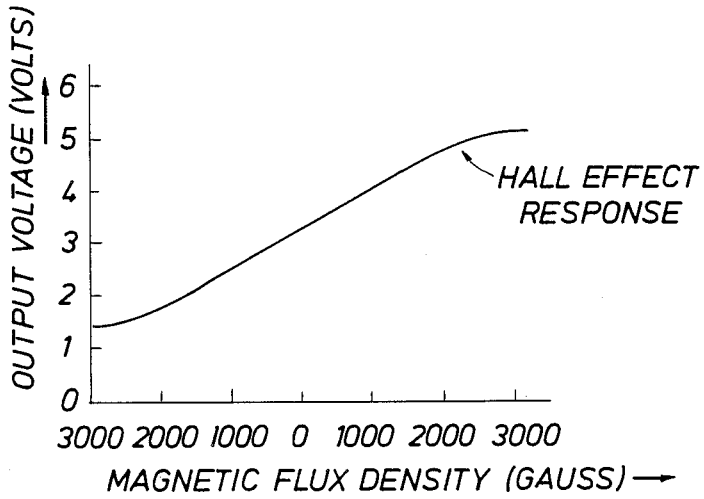
FIG. 4 is a graphical representation illustrating the output of the Hall effect device as a function of magnetic flux density.

Referring now to FIG. 4 the Hall effect response as a function of magnetic field intensity or flux density is illustrated in graphical form. It will be noted that the magnetic field in opposite directions produces opposite signed Hall voltage about the point of zero magnetic field. The response of the device is approximately linear over its range of operation as indicated in the graphical relationship of FIG. 4. By connecting a pair of such devices and using flux concentrators 33 and 34 as illustrated in FIG. 2, both absolute magnetic field strength and differential magnetic field strength may be measured at longitudinally spaced distances in the downhole sonde 15 of FIG. 1. Typically the Hall effect devices may be spaced by about one foot from each other.

Figure 5:
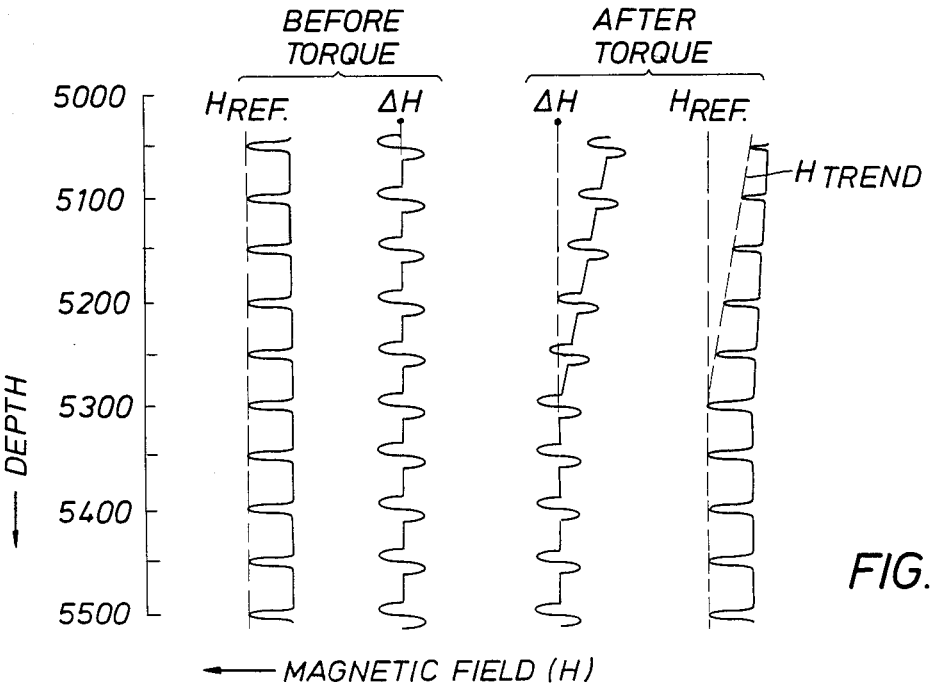
FIG. 5 is a schematic diagram illustrating magnetic mark measurements as a function of depth made according to the concepts of the present invention.

In operation, the downhole sonde is moved along the stuck pipe or casing and the control circuits 22 at the surface supply DC pulses to the marking coil 16 in the sonde. These DC pulses mark the inside of the pipe with residual magnetic fields at intervals as a function of depth. The downhole sonde 15 is then lowered to a depth at which the marking started, for example in FIG. 5 say 5500′ and is moved up the borehole recording both the absolute magnetic field intensity and the differential magnetic field as a function of depth as illustrated in FIG. 5 in the two recordings marked "Before Torque".

The stuck pipe or tubing is then stressed by applying a torque or lifting force or both from the surface and while the pipe is under the stress the instrument is lowered to the initial measuring point and moved upwardly through the hole again. This results in the two curves recorded as a function of depth and labeled "After Torque" in FIG. 5.

It may thus be seen that both the absolute magnetic field intensity of the marks and the amplitude of the differential magnetic field are affected by the strain on the pipe caused by the lifting and torquing force at least in the part of the pipe which is free to move, i.e. that part between the surface and the freepoint or stuck point. Thus the freepoint or stuck point of the pipe may be located in this manner.

The foregoing disclosure may make other alternative embodiments of the invention apparent to those skilled in the art. The aim of the appended claims is to cover all such changes and modifications which fall within the true spirit and scope of the invention.

What is claimed is

1. A freepoint indicator system for use in determining the free point of stuck drill pipe or tubing in a well borehole comprising:

a fluid tight non-magnetic hollow body member sized and adapted for passage through a well borehole, said body member housing;

coil means for marking the inside of drill pipe or tubing with magnetic marks by passing a DC current pulse through said coil means;

first Hall effect transducer means spaced longitudinally in said body member from said coil means for detecting magnetic fields and generating signals representative thereby;

second Hall effect transducer means spaced longitudinally from said coil means and said first transducer for detecting magnetic fields and generating signals representative thereof;

means for transmitting said representative signals from said body member to the surface of the earth; and means for generating a signal representative of the difference in said two representative magnetic field signals and for recording said difference signal as a function of borehole depth.

2. The system of claim 1 and further including means for recording said magnetic field representative signals as a function of the depth of said body member in the borehole.

3. The system of claim 1 and further including a pair of flux concentrators located near said Hall effect transducers to provide concentration of magnetic flux emanating from residual magnetic marks in said tubing.

4. The system of claim 3 wherein said magnetic flux concentrators comprise tapered ferro magnetic pyramidal frustrums deployed between said Hall effect transducer and the other wall of said body member.

5. The system of claim 1 wherein said coil means comprises a solenoid coil optimized for ampere turns of DC current to create a large magnetic marking field.

6. The apparatus of claim 1 wherein said Hall effect devices comprise signal ended output devices producing an output signal proportional to the magnetic field present at its location and independent of the speed of movement of the device.

7. The method for detecting the free point of pipe or tubing stuck in a well borehole, comprising the steps of:

moving a DC current supplied marking coil housed in a fluid tight non-magnetic body member sized and adapted for passage through a well borehole through a stuck pipe or tubing string in a borehole and repetitively pulsing said coil with pulses of DC current to cause a plurality of residual magnetic marks on the interior portions thereof;

detecting at a first longitudinally spaced distance from said coil, the amplitude of residual magnetic marks caused by said marking coil generating signals representative thereof by moving a Hall effect transducer past said marks to generate said signals;

detecting at a second longitudinally spaced distance from said coil, the amplitude of residual magnetic marks caused by said marking coil and generating signals representative thereof by moving a Hall effect transducer past said marks to generate said signals;

recording said representative signals as a function of borehole depth prior to and subsequent to applying a pulling force or a torque or both to the upper end of said stuck pipe or tubing string; and generating a signal representative of the difference in said longitudinally spaced magnetic field representative signals and recording said representative difference signal as a function of borehole depth.

8. The method of claim 7 wherein the steps are performed repetitively and each of said three representative magnetic field measurement signals are recorded as a function of borehole depth.

* * * * *